US010165842B1

(12) United States Patent
Teele

(10) Patent No.: US 10,165,842 B1
(45) Date of Patent: Jan. 1, 2019

(54) REUSABLE MULTI-BOWL DEVICE FOR USE IN HAIR COLORATION

(71) Applicant: Yvonne M. Teele, Farmington, ME (US)

(72) Inventor: Yvonne M. Teele, Farmington, ME (US)

( * ) Notice: Subject to any disclaimer, the term of this patent is extended or adjusted under 35 U.S.C. 154(b) by 0 days.

(21) Appl. No.: 15/684,405

(22) Filed: Aug. 23, 2017

(51) Int. Cl.
*B65D 25/20* (2006.01)
*A45D 19/06* (2006.01)
*B65D 21/02* (2006.01)
*B65D 25/28* (2006.01)

(52) U.S. Cl.
CPC ..... *A45D 19/06* (2013.01); *B65D 21/0206* (2013.01); *B65D 25/20* (2013.01); *B65D 25/2888* (2013.01)

(58) Field of Classification Search
CPC . B65D 21/0206; B65D 25/2888; A45D 19/06
USPC ..... 206/459.5
See application file for complete search history.

(56) References Cited

U.S. PATENT DOCUMENTS 748,026 A * 12/1903 Sussmilch ..... B44D 3/02 188/153 R
1,391,028 A * 9/1921 Werntz ..... B44D 3/04 206/1.8
1,595,356 A * 8/1926 Moseman ..... A47G 19/02 220/23.8
D437,659 S 2/2001 Mikael
D471,668 S 3/2003 Cheung
D536,131 S 1/2007 Kipry et al.
7,441,675 B2 10/2008 McGinley et al.
8,528,123 B2 9/2013 Hashem et al.
D696,072 S 12/2013 Hsu
D744,186 S 11/2015 Gringer et al.
D788,372 S 5/2017 Reed et al.
D804,964 S 12/2017 Bennett
D825,105 S 8/2018 Zur Wiesche et al.
2002/0144914 A1* 10/2002 Woskoski ..... A47G 19/2227 206/217
2003/0159306 A1 8/2003 Yeung
2004/0129599 A1 7/2004 Yi-Hung
2004/0149783 A1 8/2004 McGinley
2007/0101629 A1 5/2007 Deniz
2008/0156815 A1* 7/2008 Coff ..... A47J 41/00 220/592.2
2010/0200012 A1 8/2010 Sloan
2011/0094070 A1 4/2011 Newton
2013/0206641 A1 8/2013 Newton
2014/0090992 A1* 4/2014 Kim ..... A45D 19/00 206/219

* cited by examiner

*Primary Examiner* — King M Chu
(74) *Attorney, Agent, or Firm* — Leber IP Law; Dennis R. Haszko

(57) ABSTRACT

A device having multiple bowls for mixing colorants. The device includes lateral tabs adjacent each bowl for erasably labeling the tabs with the identification of the contents of the corresponding bowl. A centrally located timer mechanism is provided to time the colorant mixture setting times and a marker ring is rotatably provided around the timer mechanism to selectively indicate the bowl in use and being timed.

8 Claims, 24 Drawing Sheets

REUSABLE MULTI-BOWL DEVICE FOR USE IN HAIR COLORATION

FIELD OF THE INVENTION

This invention relates generally to hair and beauty equipment and more particularly to color mixing devices the like.

BACKGROUND OF THE INVENTION

In the field of cosmetology and particularly the area of hair coloration, there are known methods of mixing colorants. Often such methods will involve one or more colorants mixed by hand in a cup. The mixture may require some duration of setting time whereby a user will utilize a separate timing device. In the setting of a professional hair salon, several customers may be present and undergoing simultaneous hair coloration. As well, one specific customer's hair color treatment may involve multiple different colors, highlights, or tints. Thus, it is important to keep track of multiple cups having differing colorants. Some prior art devices exist to assist a hair stylist in this effort.

US Patent Application Publication number 2013/0206641 discloses a specifically contoured smooth, hard plastic, dark colored hair coloring formula identification clip device, a system of its use, and a method of steps to track and achieve a desired outcome. The hair coloring identification clip preferably includes a stain and water resistant, peel and stick, replaceable, wet erase writing surface label portion.

US Patent Application Publication number 2011/0094070 discloses a hair coloring formula identification clip device, system, and method. The hair coloring identification clip preferably includes a writable and erasable surface portion.

US Patent Application Publication number 2007/0101629 discloses an apparatus comprising: first and second separate elongated flexible members with first and second opposite ends. An elongated hinge interconnecting the second ends of the first and second members and extends between horizontally between them. The hinge urges the free lower ends of both first and second members toward each other. The hinge has a recessed central region. A third member has upper and lower edges with a hinge connector secured to the lower edge. The connector engages the recessed central region of the hinge and is pivotally secured to the hinge.

The present invention overcomes one or more deficiencies of the prior art.

SUMMARY OF THE INVENTION

The present invention provides a device that enables a hair stylist to quickly and easily mix and time multiple colorants in an organized and reusable manner. It should be understood that the present invention may be utilized by hair stylists, beauticians, hairdressers, cosmetologists, barbers, or any similar individual wishing to mix multiple colorants.

In accordance with a first aspect, the present invention provides a reusable multi-bowl device for use in a beauty salon, said device including: a base having a periphery and a central cavity; a plurality of lateral tabs arranged around the periphery, the tabs having an erasable surface; and a plurality of bowls arranged between the central cavity and the periphery.

In accordance with another aspect, the present invention further provides a timing mechanism.

In accordance with still another aspect, the present invention provides marker ring indicating a particular bowl in use.

These and other aspects will become apparent from the following drawings and detailed descriptions of exemplary embodiments.

DETAILED DESCRIPTION

The following detailed description provides examples of presently contemplated modes of implementing embodiments of the invention. This description is not to be taken in a limiting sense, but is made merely for the purpose of illustrating general principles of embodiments of the invention. The scope of the invention will be best defined by the claims.

Figure 1:
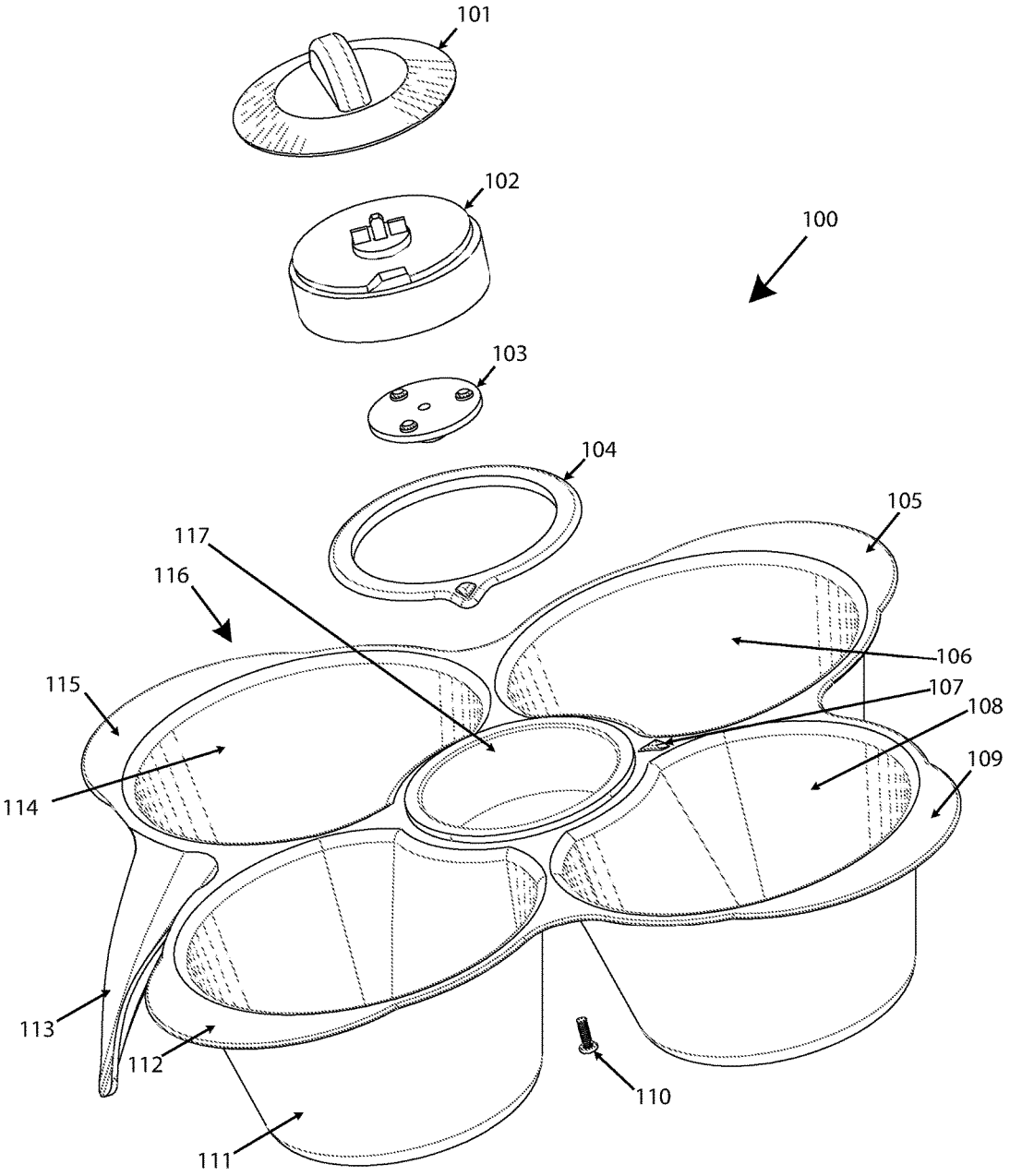
FIG. 1 shows an exploded view of a preferred embodiment of the present invention.

The present invention is a multi-bowl device which includes five main parts as illustrated by FIG. 1. In the preferred embodiment as shown, the invention is illustrated as a quad-bowl device. Here, an exploded view the quad bowl device 100 is shown having a timer knob 101, timer mechanism 102, timer pedestal 103, marker ring 104, and bowl base 116. It should be understood that the timer mechanism 102 may be any known timer of timing apparatus well known in the timer art including, but not limited to mechanical, electromechanical, digital, or electronic timing mechanisms. If such mechanical timers are used, it should be noted that they will of course include known "wind up" inner workings typical of manual timers. Such inner workings, whether mechanical, electromechanical, digital, or electronic, are outside the scope of the present invention and therefore not shown or described in any detail. For the sake of illustration, the present invention is shown with a mechanical "wind-up" type of timer mechanism.

The bowl base 116 as shown includes bowls 106, 108, 111, 114 provided for insertion of colorants for mixing by a user (i.e., hair stylist). Although four bowls are shown in the preferred embodiment as seen in FIG. 1, it should be readily apparent that the bowl base may be configured with any number of bowls without straying from the intended scope of the present invention. For example, a configuration of anywhere from two to six may easily be provided by peripheral sections of bowl or varying size. Likewise, multiple bowls provided may be identically sized or may be sized differently—e.g., one large and two smaller bowls or any combination of such size variations. Any and all such arrangements may be possible and within the scope of the present invention.

The bowl base 116 also includes a cavity 117 centrally located relative to the peripherally arranged bowls and suitably dimensioned to therein retain the timer knob 101, timer mechanism 102, timer pedestal 103, and marker ring 104 via a screw 110. The screw 110 is used to retain the timer mechanism 102 in a fixed position within the cavity 117 whereby the timer mechanism 102 is connected to the timer pedestal 103 by means of the screw 110. Other fastening means may be used in lieu of screw 110 such as, but not limited to, snap fittings, grommets, or permanent bonding agents. Such arrangement with regard to the screw 110 is better shown and described hereinbelow with further reference to FIG. 7.

Figure 2:
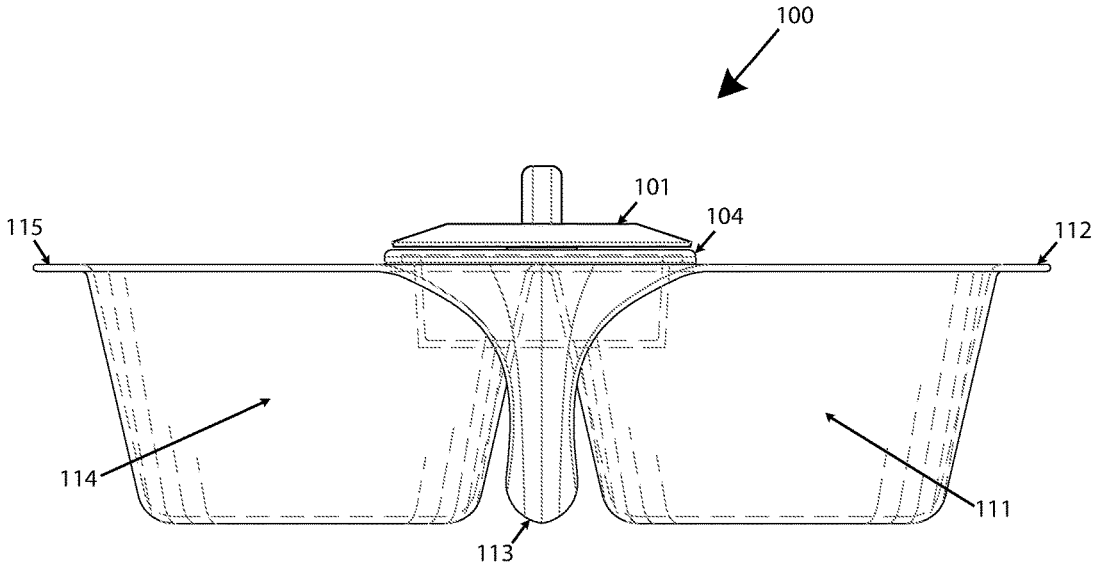
FIG. 2 is a rear view of the fully assembled invention as shown in FIG. 1.
Figure 3:
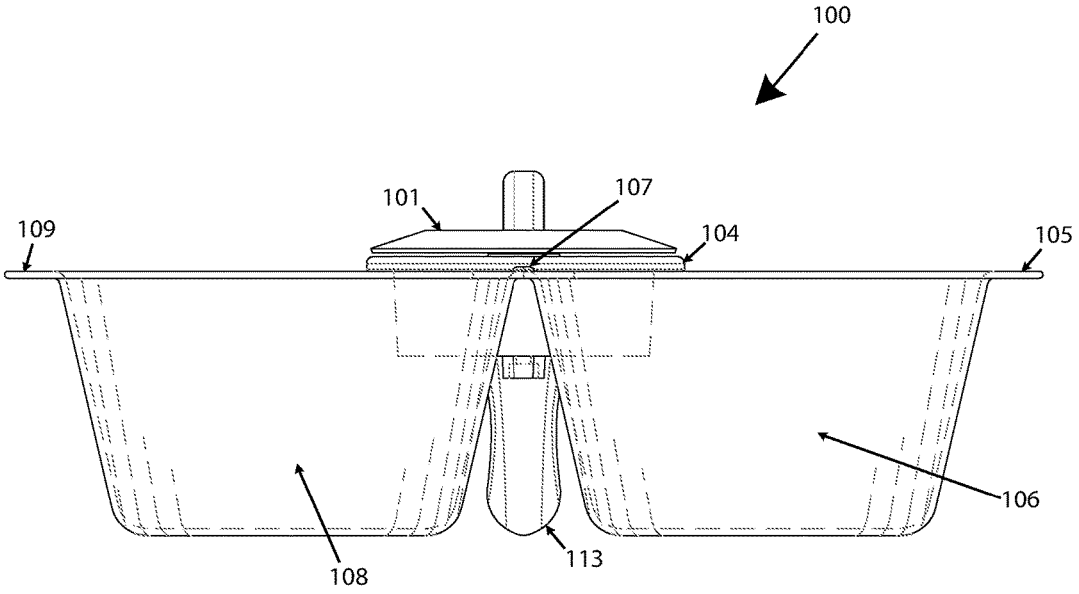
FIG. 3 is a front view of the fully assembled invention.
Figure 4:
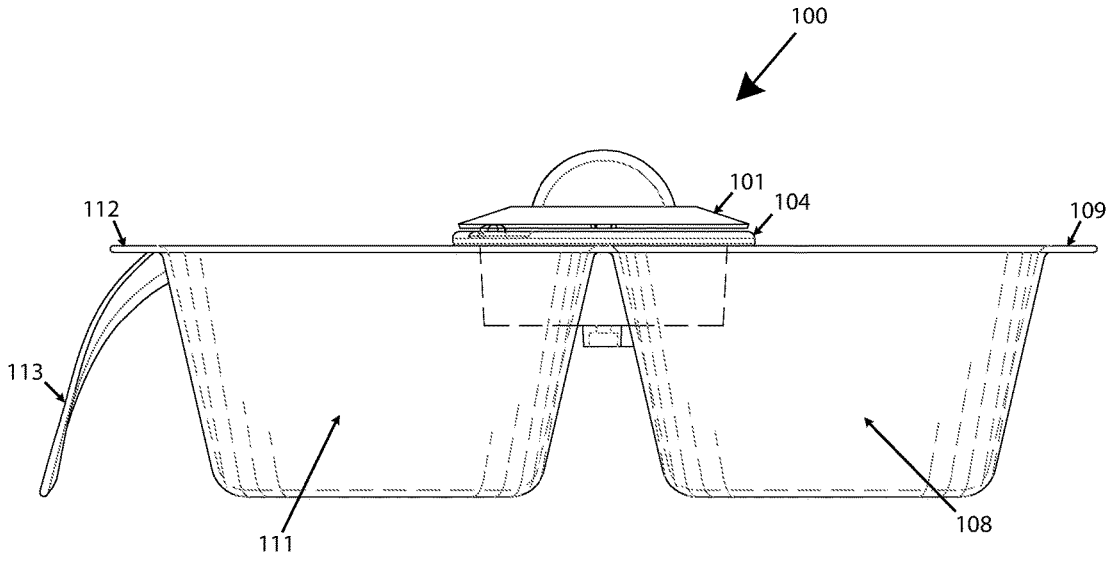
FIG. 4 is a side view of the fully assembled invention.

The bowl base 11 includes a handle 113 to enable a user to easily carry the assembled quad bowl device 100. The handle 113 may be in any shape or form including the preferred embodiment as shown which may also serve as a means for resting or otherwise holding stable a mixing utensil (not shown). It is possible that more than one handle may be provided without straying from the intended scope of the present invention. As may be better seen by way of FIGS. 2 through 4, the handle 113 extends from the top surface of the quad bowl device 100 to the bottom of the quad bowl device 100. In this way, the handle 113 serves to also stabilize the quad bowl device when placed upon a surface (e.g., work table) which precludes spillage of the colorant mixtures held within the bowls. The bottom surface of the quad may also be preferably made from or formed by a non-slip material such as, but not limited to, a rubberized surface to further inhibit the bowl slipping when in use.

With further reference to FIGS. 1 through 4, each section of the bowl base 116 including the bowls 106, 108, 111, 114 further respectively includes an extended lateral edge in the form of tabs 105, 109, 112, 115. These tabs are configured to provide sufficient surface area upon which the user may indicate the colorant mixture contained within the corresponding bowl. Each tab 105, 109, 112, 115 may be coated or otherwise formed in such a manner (e.g., smooth surfaced) such that an erasable marker may be advantageously utilized by a user rendering the quad bowl device 100 reusable for many different colorant formulations. Preferably, the tabs are fabricated of a material or otherwise surfaced such that a wax pencil may be used to mark the given mix formulation where wax may be relatively easily wiped away, but will not simply wash away if splashed.

The bowl base 116 is preferably a unitary piece fabricated from a lightweight, yet durable material such as, but not limited to, high impact plastic. Manufacture of the bowl base 116 may be by any known method such as, but not limited to, injection molding, extrusion, or cast molding. Other materials and methods may be possible such as cast ceramics or any other suitable materials or methods so long as the colorant mixtures may be washed out of each bowl for reuse of the device and the tabs may be erased for re-writing.

The timer knob 101, timer mechanism 102, timer pedestal 103, marker ring 104, and screw 110 may be fabricated in any known manner and may or may not be selected from materials matching the bowl base 116. For example, the timer knob 101 and marker ring 104 may be formed of plastic the same or similar manner as the bowl base 116. Likewise, dyes within the material may be used to form a unitary color or alternatively fanciful coloration in the visible surfaces of the timer knob 101, timer mechanism 102, timer pedestal 103, marker ring 104, and bowl base 116.

Figure 5:
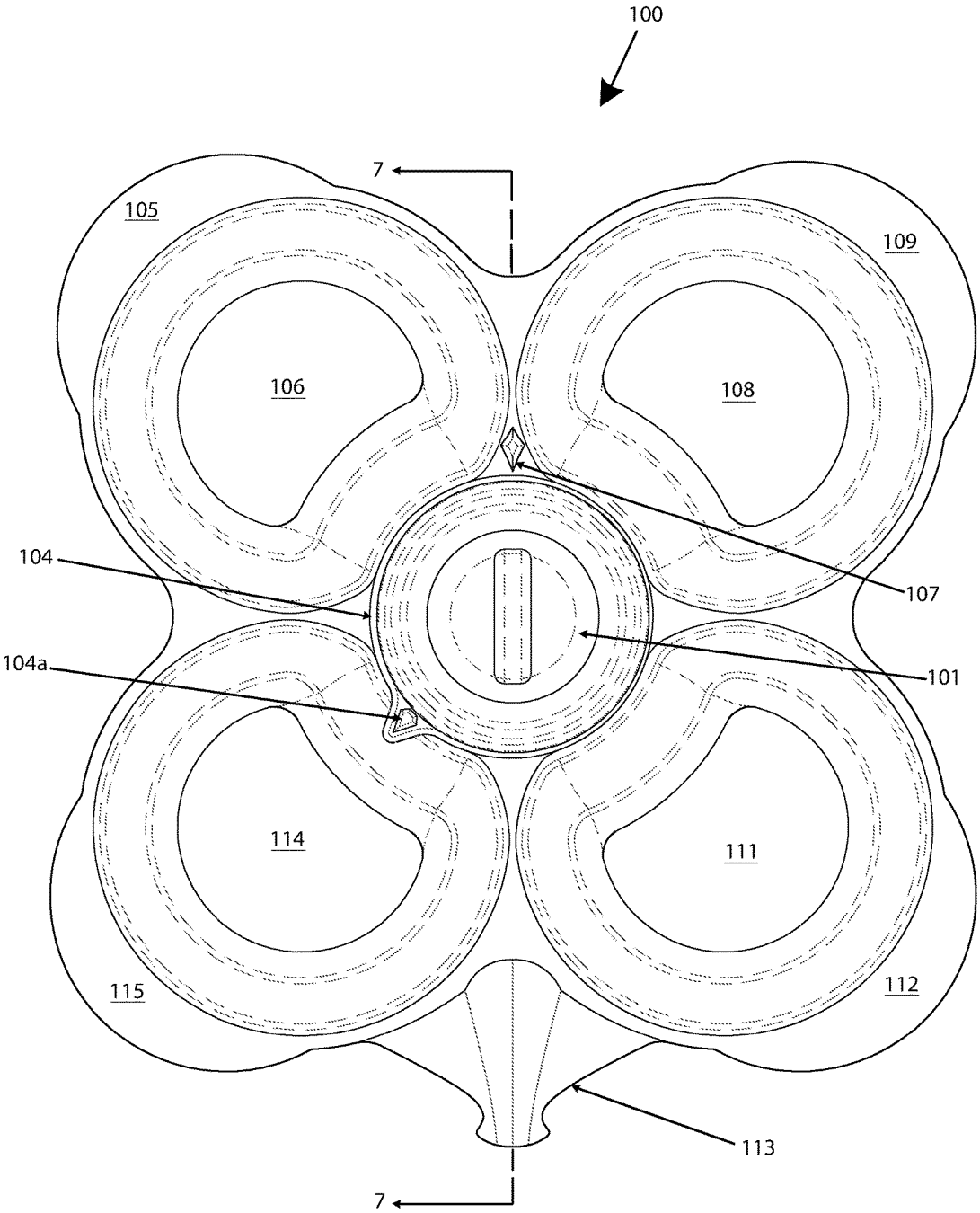
FIG. 5 is a top plan view of the fully assembled invention.
Figure 6:
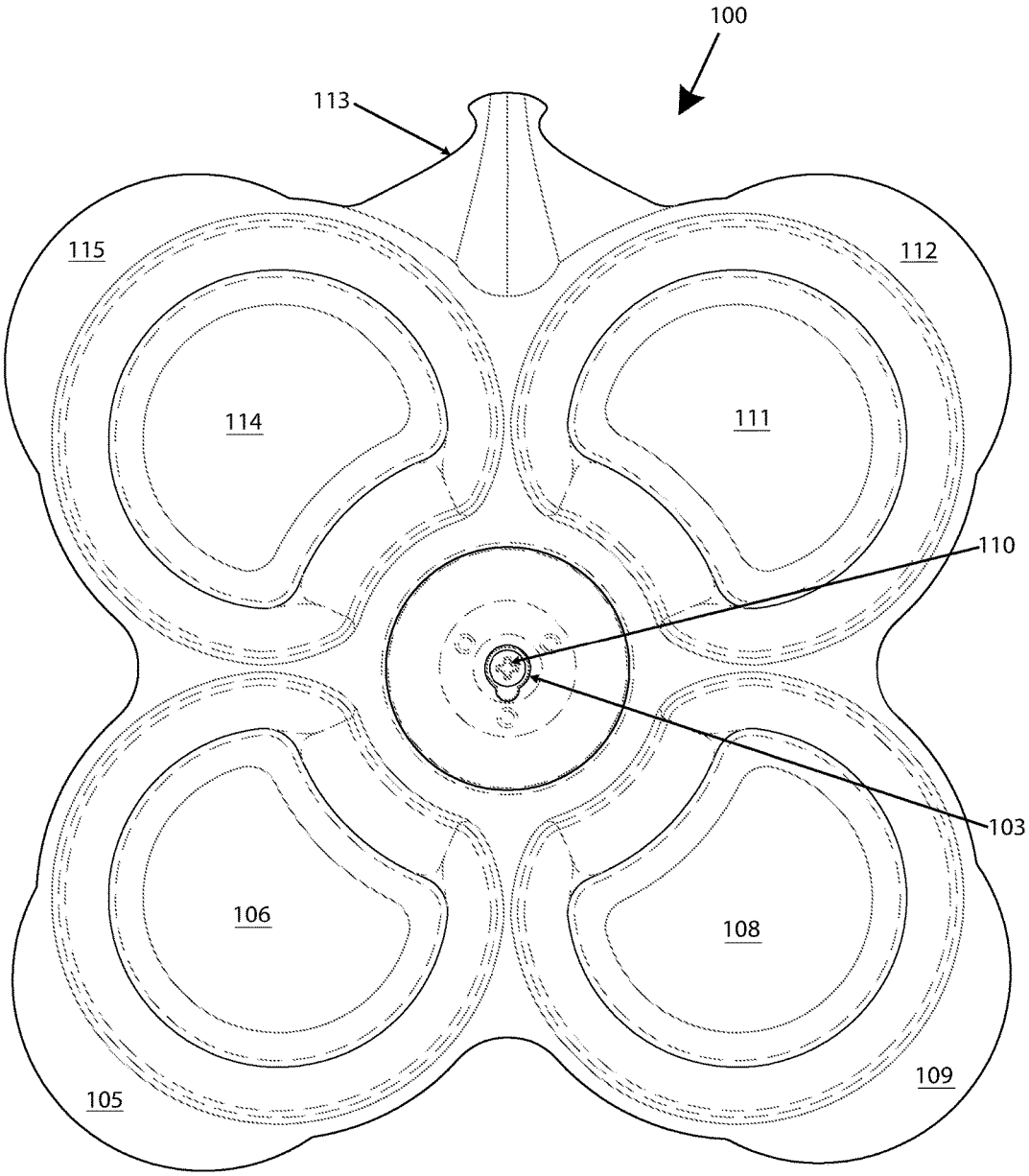
FIG. 6 is a bottom view of the fully assembled invention.

FIGS. 5 and 6 show, respectively, top and bottom plan views of the assembled quad bowl device 100. Here, the relationship between each bowl 106, 108, 111, 115 and the marker ring 104 may be seen. In particular, the marker ring 104 is rotatable such that a marker element 104*a* on the marker ring 104 is movable so as to indicate the particular bowl being used at any instance in time. For example, as seen by way of FIG. 5, the marker element 104*a* is in position adjacent to bowl 115 thus indicating that bowl 115 is the specific bowl being used while the other bowls 106, 108, 111 are not being used. It should be noted that the use of the marker element 104*a* is particularly important when the other bowls 106, 108, 111 have had colorations previously placed therein. This avoids user error in applying colorations which may vary only slightly to the naked eye. As well, the marker element may indicate the given bowl/colorant being used whereby a user stepping away (for example to take a phone call) may then return to the same point in the hair coloring process where they left off without confusion as to which bowl/colorant was being used before the distraction.

With continued reference to FIG. 5, the tabs 105, 109, 112, and 115 are clearly shown as lateral protrusions which provide ample surface area upon which the user may indicate the particular coloration formulation which corresponds to the particular bowl adjacent the given tab. As previously mentioned, the user may use an erasable marker of any known kind in order to write upon the erasable surface of each tab. Thus, each bowl may be used, cleaned, and re-used many times over for multiple colorations. Each bowl is preferably "D" shaped in that the bowls each have one relatively curved surface, one relatively flat surface, and a flat bottom. Such bowl surface variations are useful to facilitate the user's manual mixing of colorations within each bowl.

Figure 18:
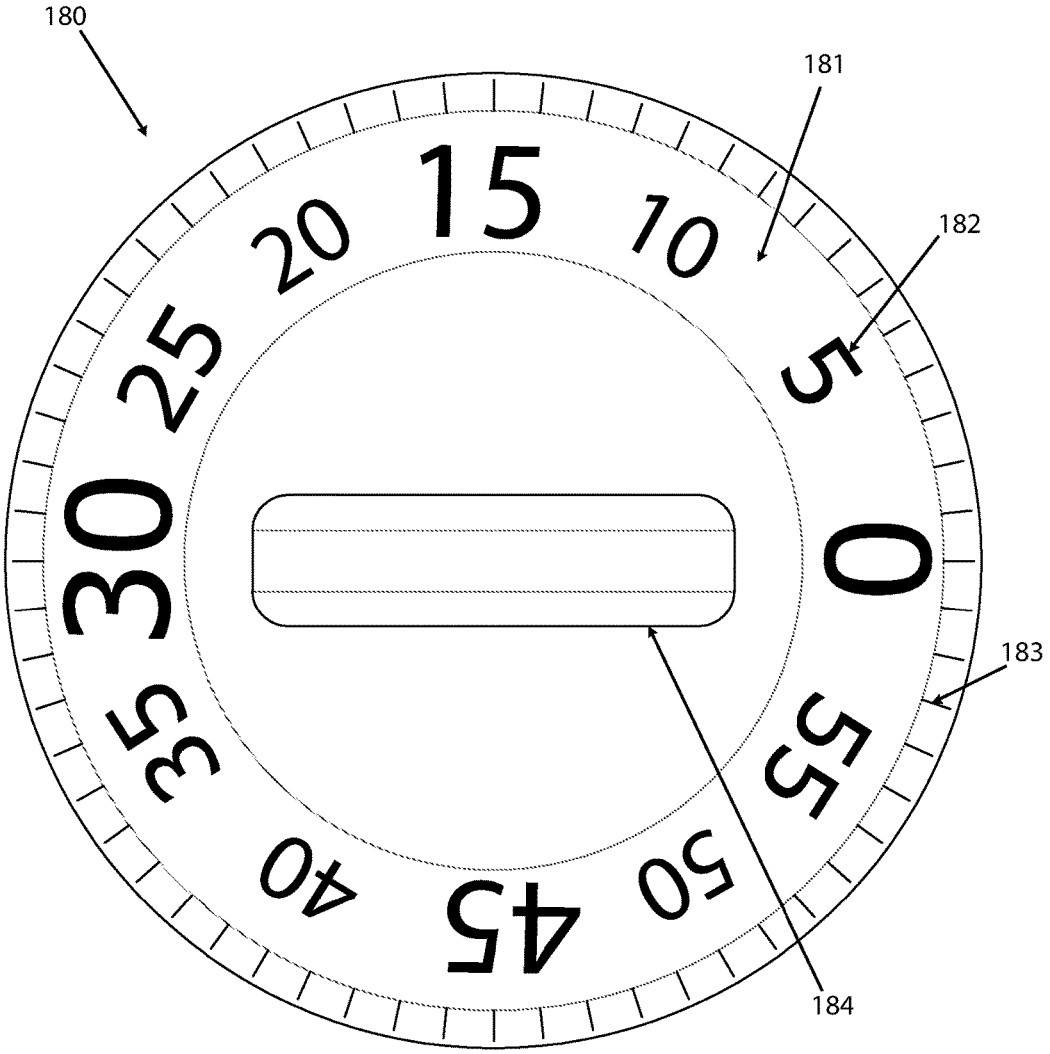
FIG. 18 is top plan view of another timer knob portion of the present invention shown including numeric indicia.
Figure 19:
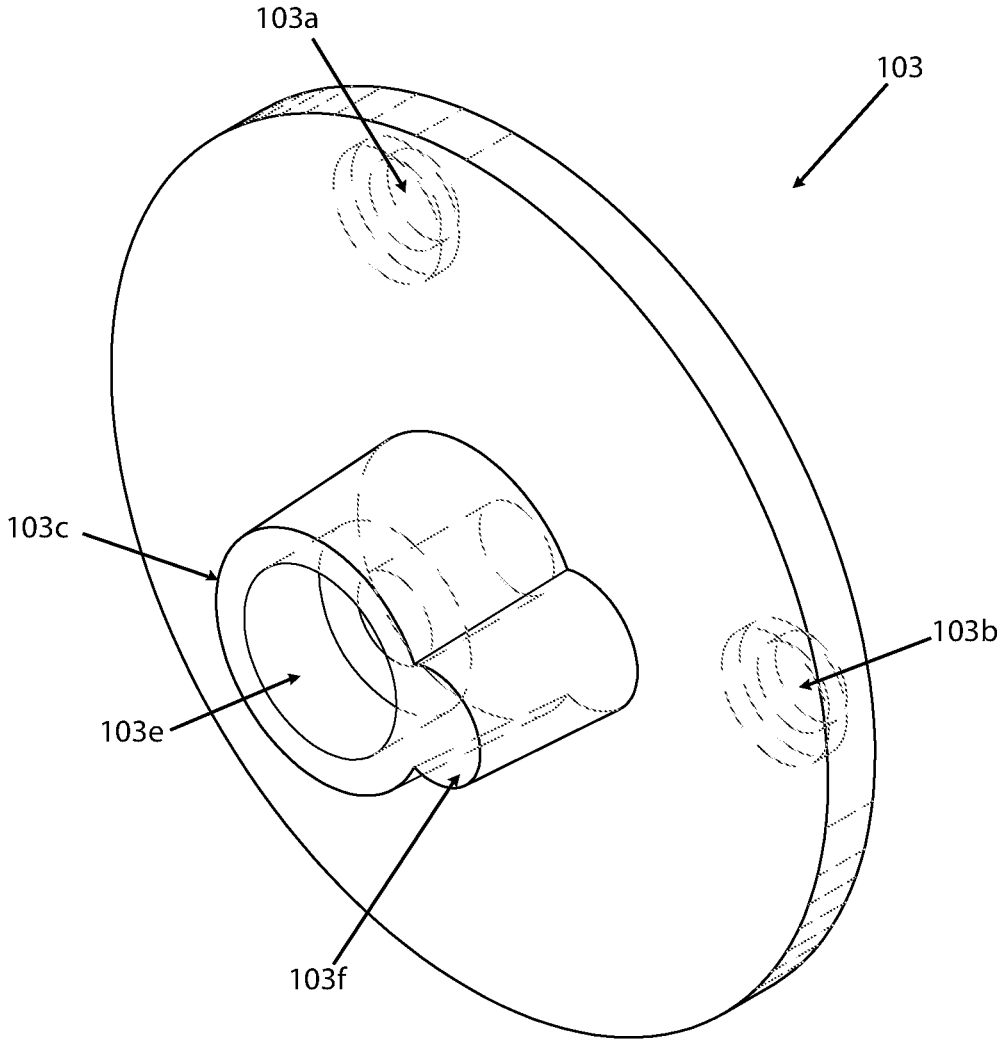
FIG. 19 is an isometric bottom-side view of the timer pedestal portion of the present invention as shown in FIG. 1.
Figure 20:
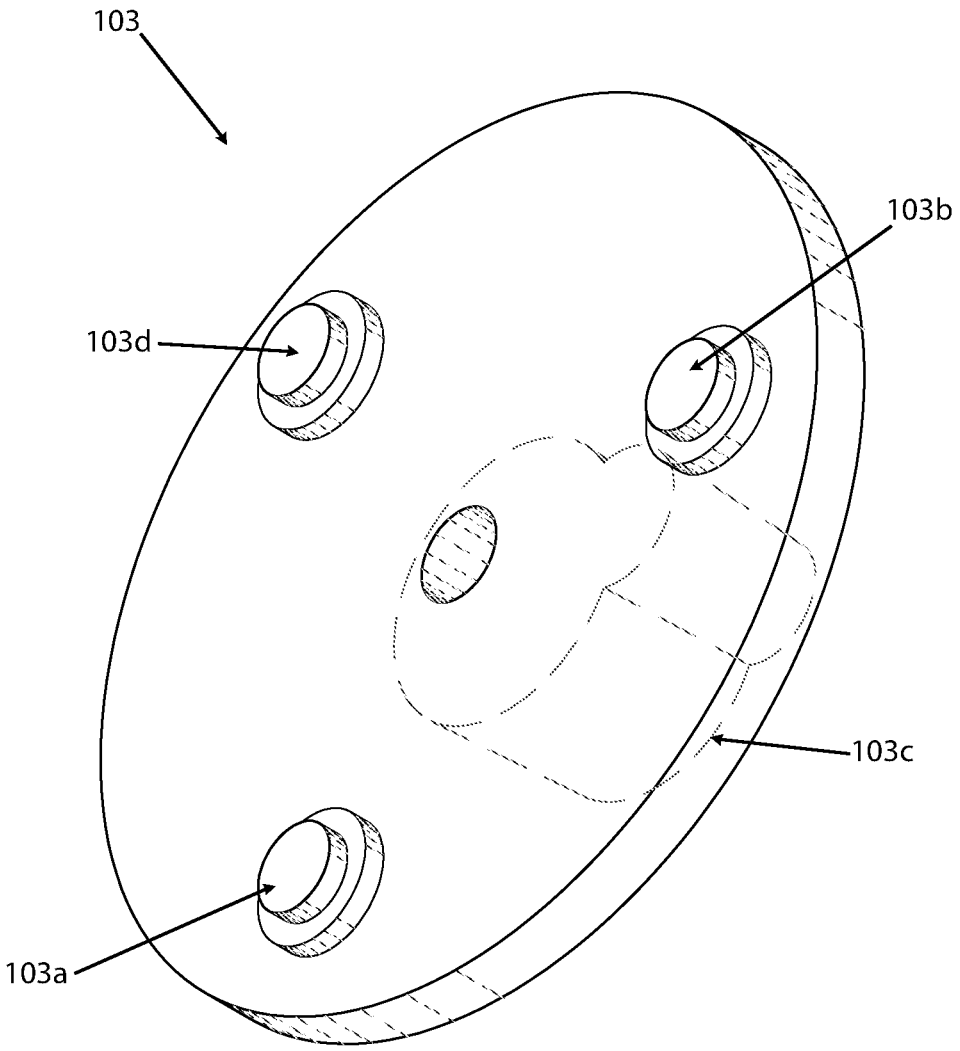
FIG. 20 is an isometric top-side view of the timer pedestal portion of the present invention.
Figure 21:
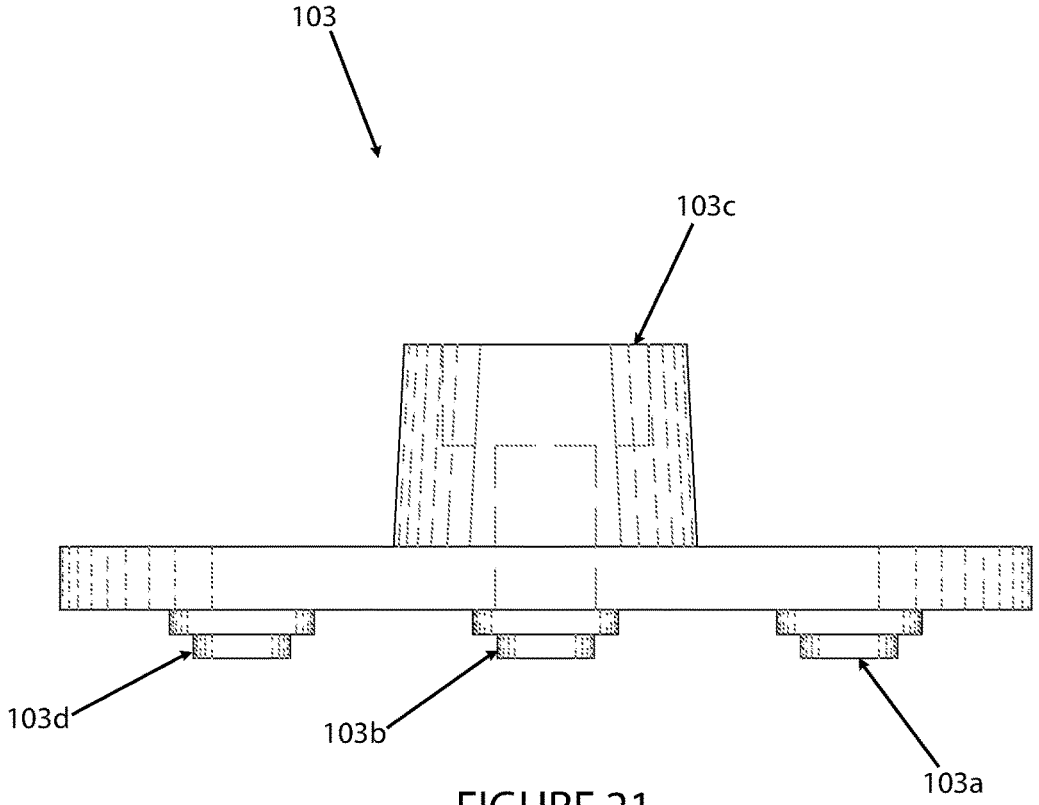
FIG. 21 is rear view of the timer pedestal portion of the present invention.
Figure 22:
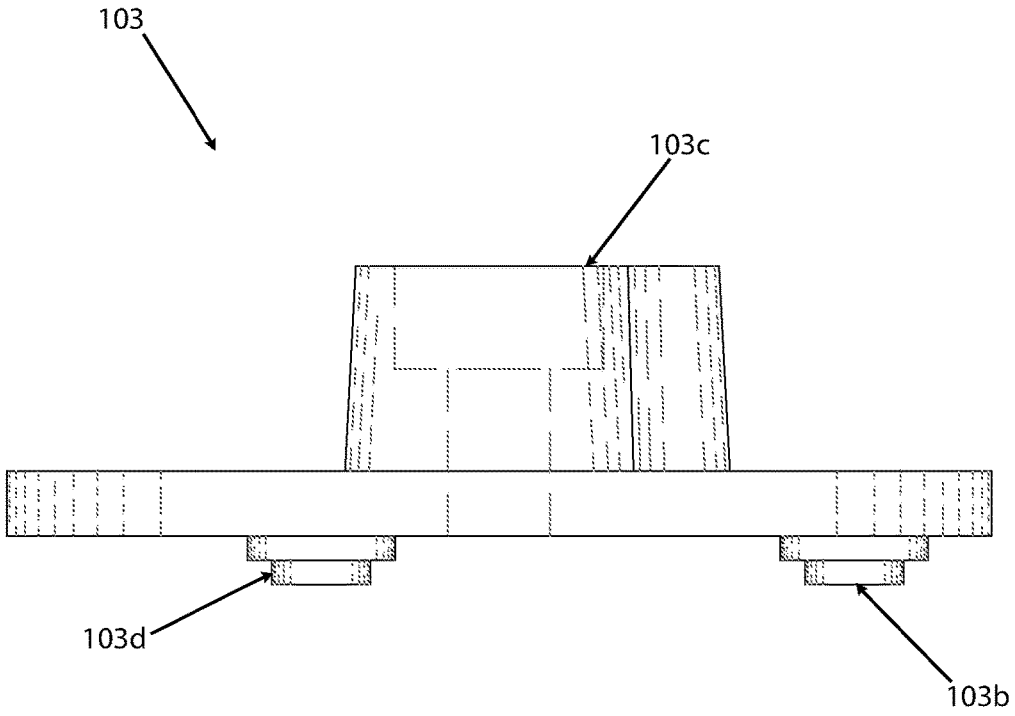
FIG. 22 is a side view of the timer pedestal portion of the present invention.
Figure 23:
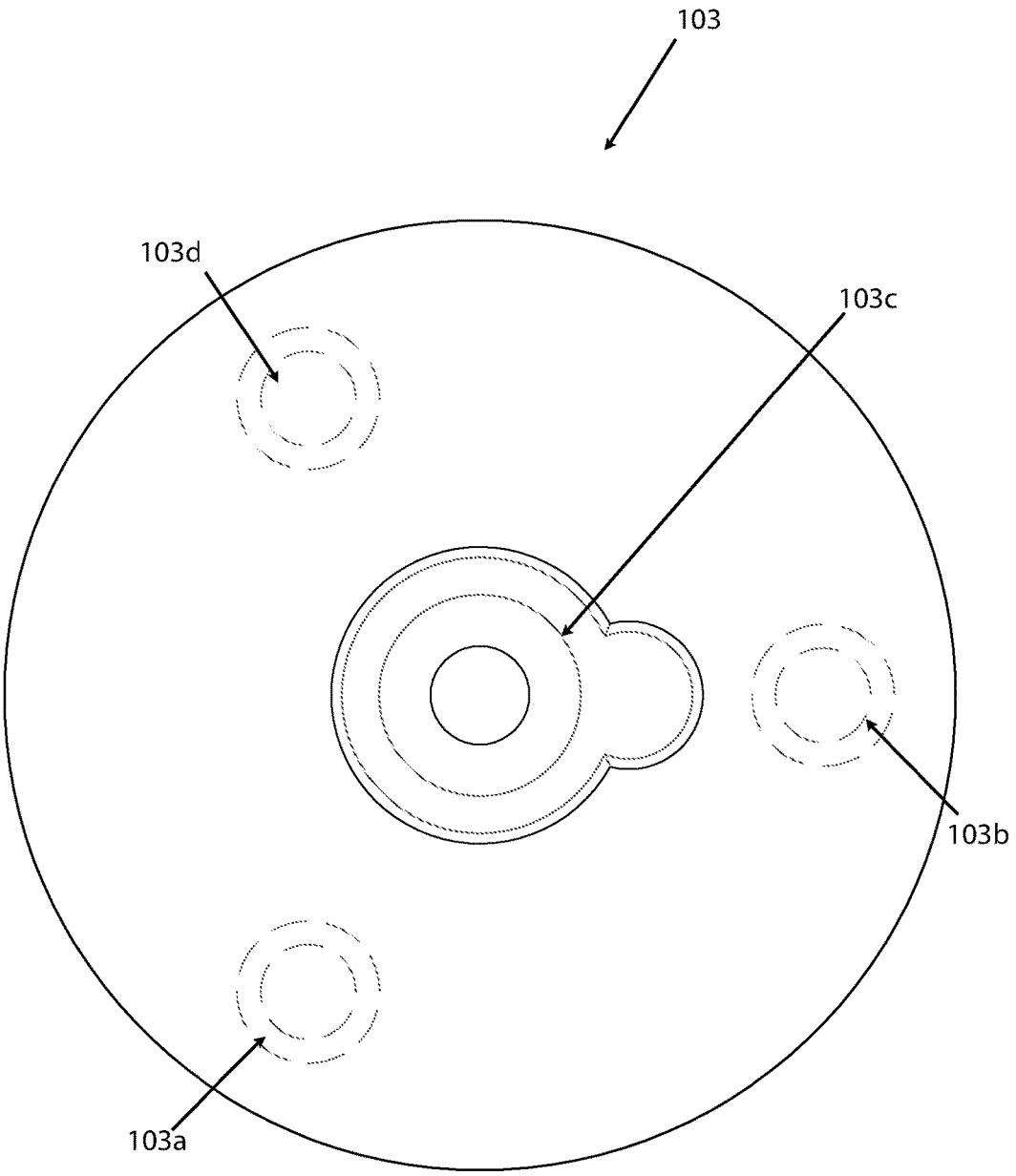
FIG. 23 is a bottom plan view of the timer pedestal portion of the present invention.
Figure 24:
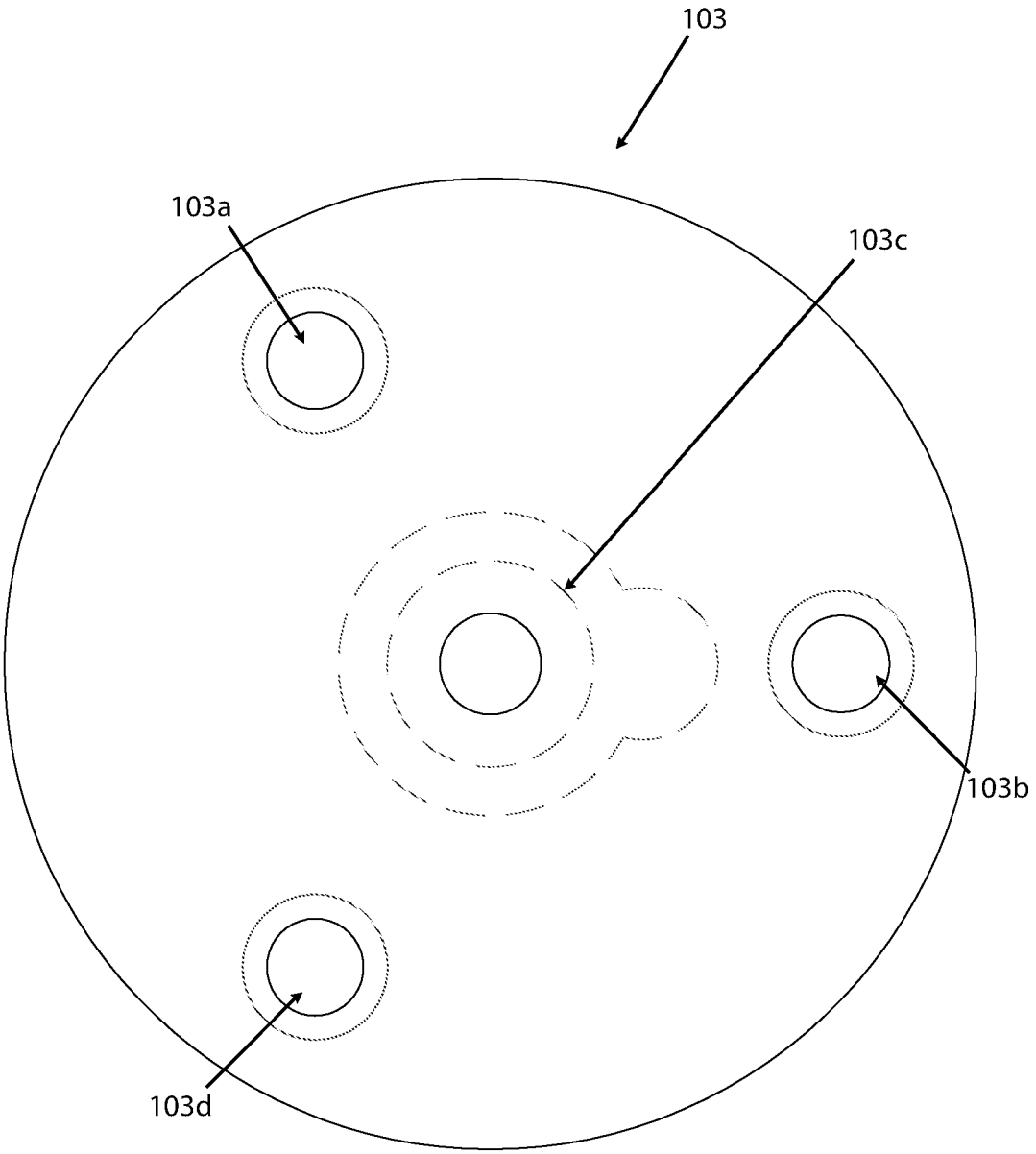
FIG. 24 is a top plan view of the timer pedestal portion of the present invention.

Affixed to the quad bowl device 100 is a timing mark 107. While the timing mark 107 is shown adjacent bowls 106 and 108, it should be understood that the timing mark may be fixed to the top surface of the quad bowl device 100 in any appropriate location so that it may function as the demarcation point for when the timer stops. The timer knob 101 may utilize any indicia on its face for the passage of time. The timer knob 101 is shown in FIG. 5 with a generic face. However, one alternative example is shown as a sixty second timer knob 180 as seen in FIG. 18 whereby the particular timer used would be designed to rotate between a preset zero and sixty seconds. In FIG. 18, knob 180 includes a turn element 184 for manually setting the timer to which the knob is attached along with a number area 181 with numerals 182 and a peripheral edge having hash marks 183 designed to align with the timing mark. Other variations of timer face indicia may be possible without straying from the intended scope of the present invention.

FIG. 6 is a bottom view of the fully assembled invention showing the undersides of tabs 115, 112, 109, 105 and undersides of bowls 114, 111, 108, 106 along with the underside of the handle 113. At the center is seen the screw 110 affixed within the bottom of the timer pedestal 103.

Figure 7:
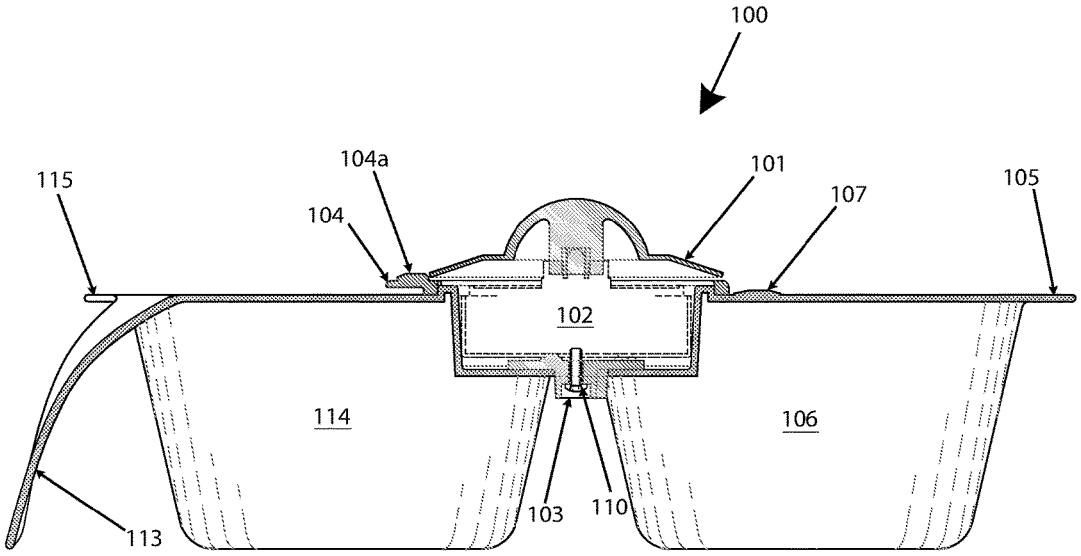
FIG. 7 is a side sectional view of the present invention taken across line 7-7 in FIG. 5.
Figure 8:
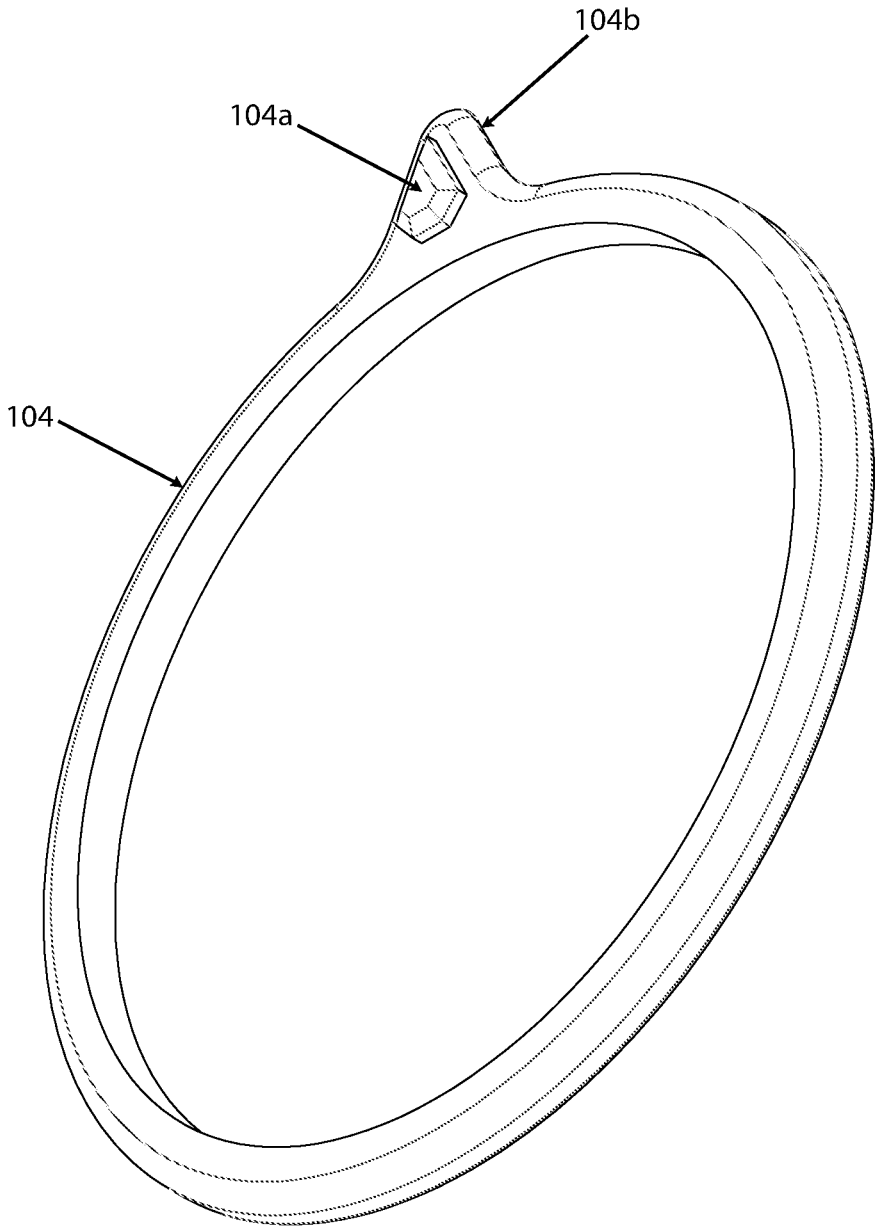
FIG. 8 is an isometric view of the marker ring portion of the present invention as shown in FIG. 1.
Figure 9:
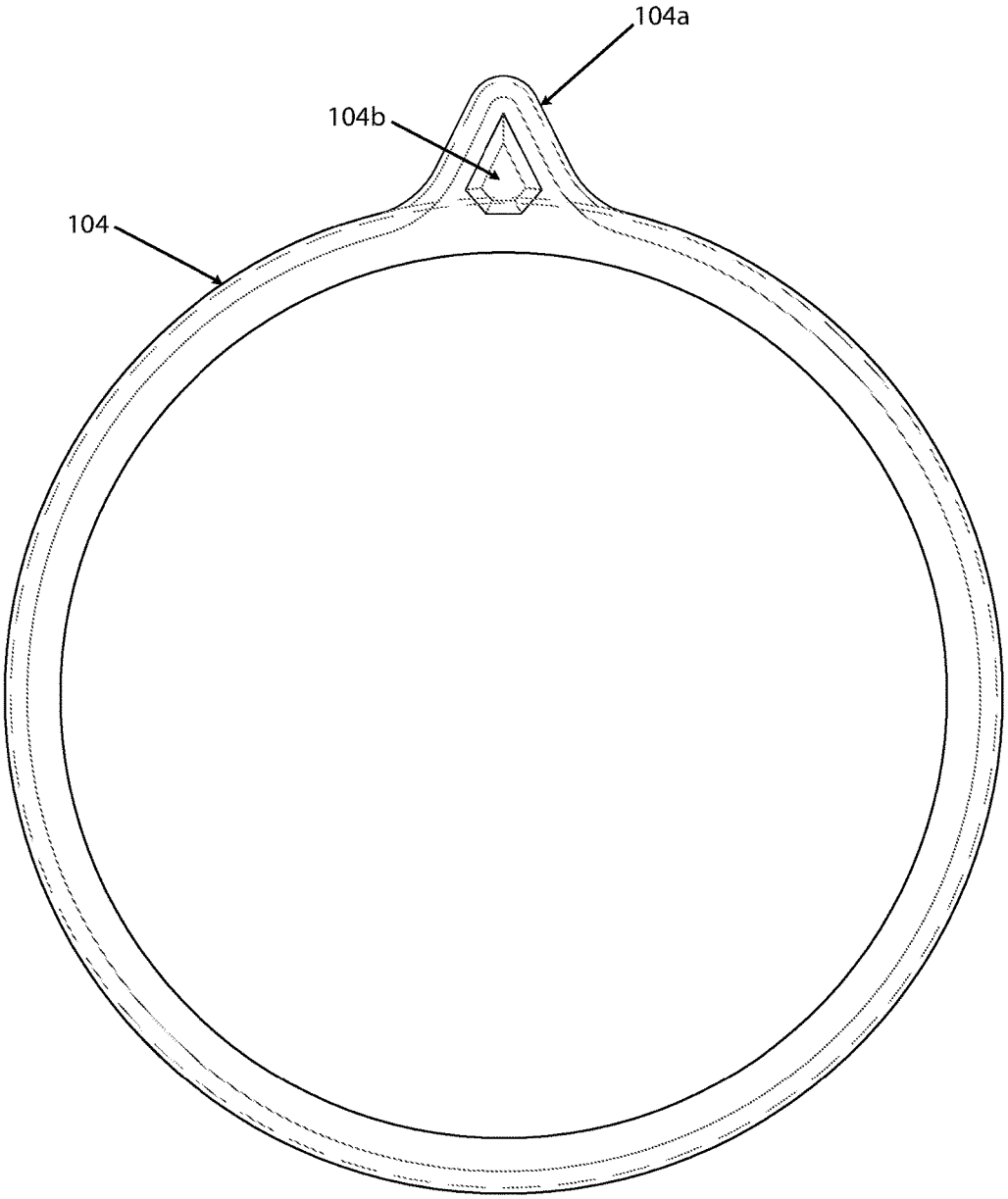
FIG. 9 is a top plan view of the marker ring portion of the present invention.
Figure 10:
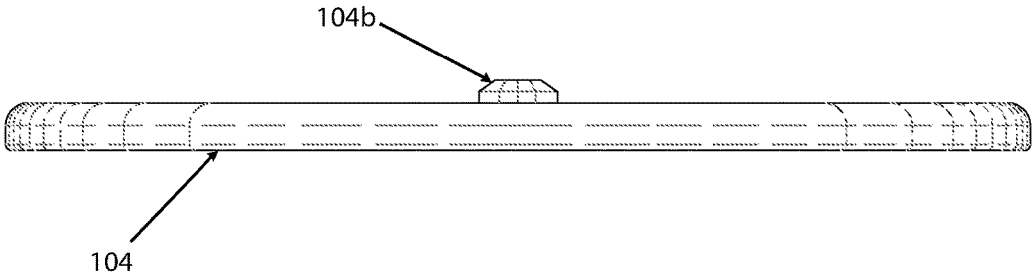
FIG. 10 is a rear view of the marker ring portion of the present invention.
Figure 11:
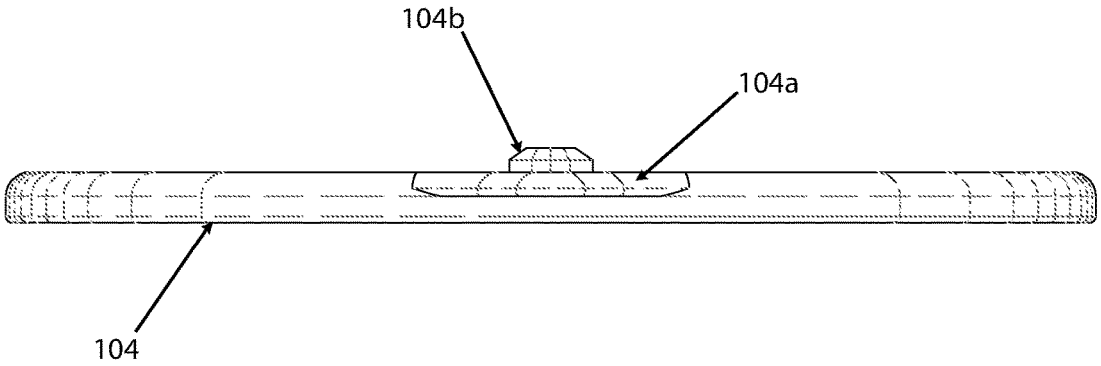
FIG. 11 is a front view of the marker ring portion of the present invention.
Figure 12:
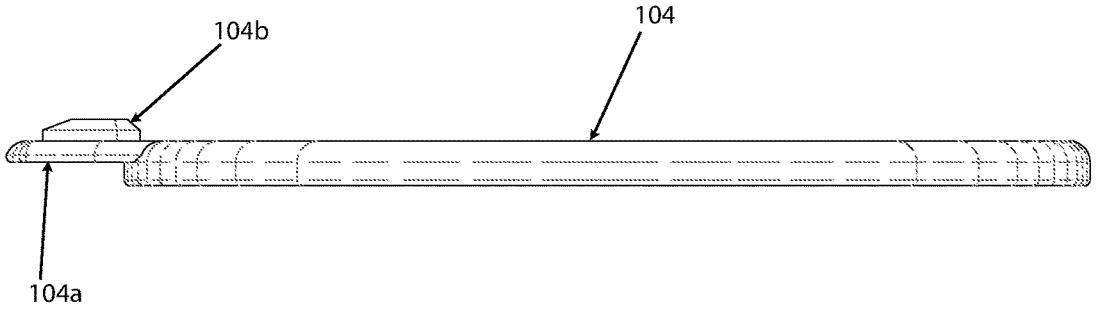
FIG. 12 is a side view of the marker ring portion of the present invention.
Figure 13:
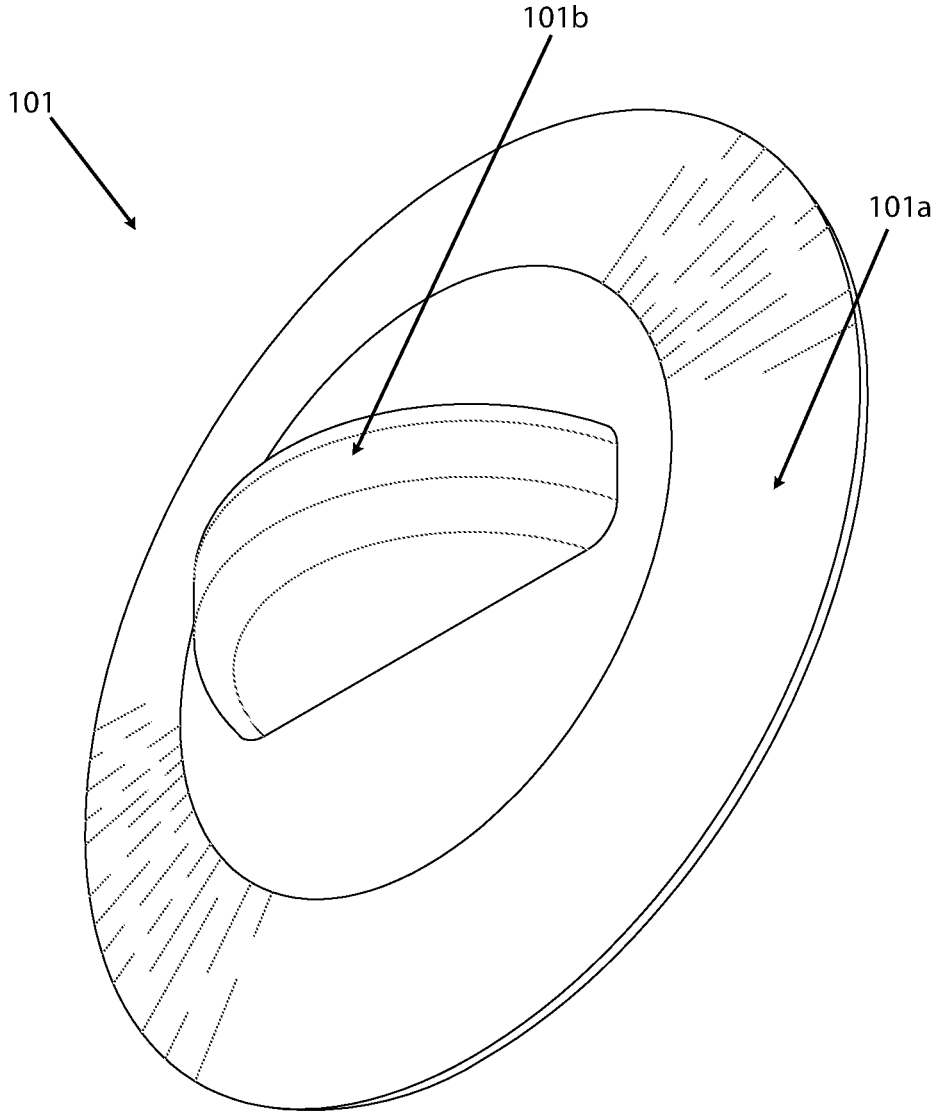
FIG. 13 is an isometric top-side view of the timer knob portion of the present invention as shown in FIG. 1.

The assembled invention is further shown and described with regard to FIG. 7. Here, there is seen a side sectional view of the present invention taken across line 7-7 in FIG. 5 revealing the relative positioning for the timer knob 101, marker ring 104, timer mechanism 102 (shown in dotted line for clarity of illustration), timer pedestal 103, and screw 110. As previously mentioned, the handle 113 extends from the top surface where tabs 115, 105 are present to the plane level with the bottom of the bowls 114, 106. In this cross section, the timing mark 107 and marker element 104*a* on the marker ring 104 are also visible.

As is evident from the cross section of FIG. 7, it should be understood that the timer pedestal is affixed to an aperture central to the bowls. The timer pedestal may be glued, heat welded, or otherwise bonded into such aperture. The timer pedestal may be customized to any particular shape for a given timer mechanism design. As such, the bowl base which basically forms the main portion of the invention including the multiple bowls may be formed separate from the timer pedestal as shown. In this manner, the bowl base may be manufactured of a single unitary configuration while different timer pedestals may be manufactured to enable use of different timer mechanisms. Alternatively, the timer pedestal may be formed integrally with the bowl base, though this may result in higher manufacturing costs and may limit the different types of possible timer mechanisms that may be used.

FIGS. 8 through 12 show the preferred shape of the marker ring 104 of the present invention in more detail than previously shown. The marker ring 104 includes a lateral protrusion 104*b* upon which the raised marker element 104*a* rests. The ring 104, protrusion 104*b*, and marker element 104*a* are preferably integrally formed.

Figure 14:
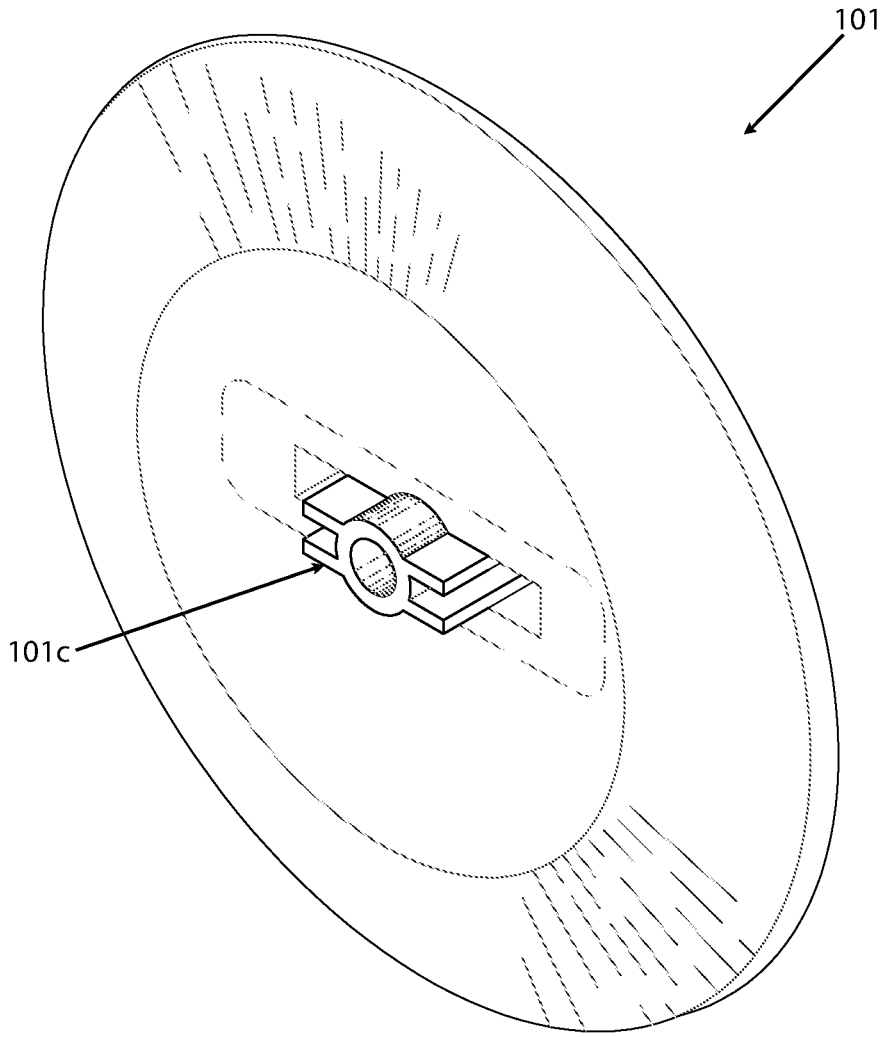
FIG. 14 is an isometric bottom-side view of the timer knob portion of the present invention.
Figure 15:
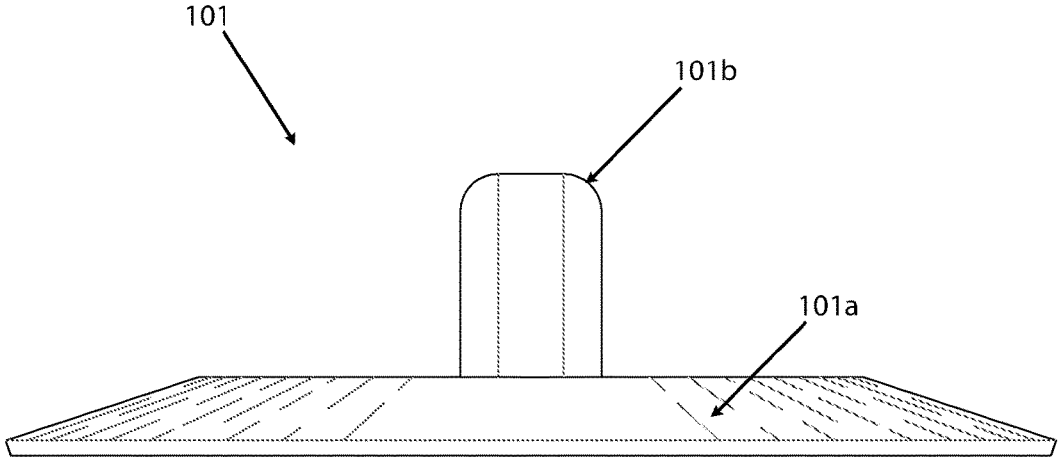
FIG. 15 is an end view of the timer knob portion of the present invention.
Figure 16:
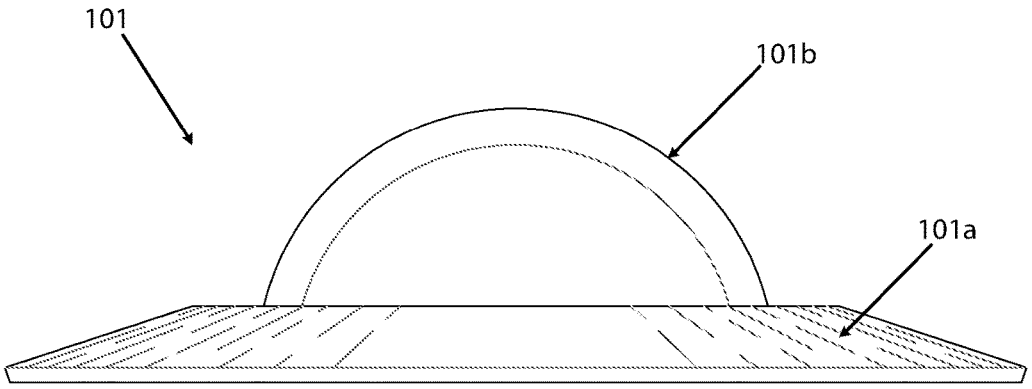
FIG. 16 is a side view of the timer knob portion of the present invention.
Figure 17:
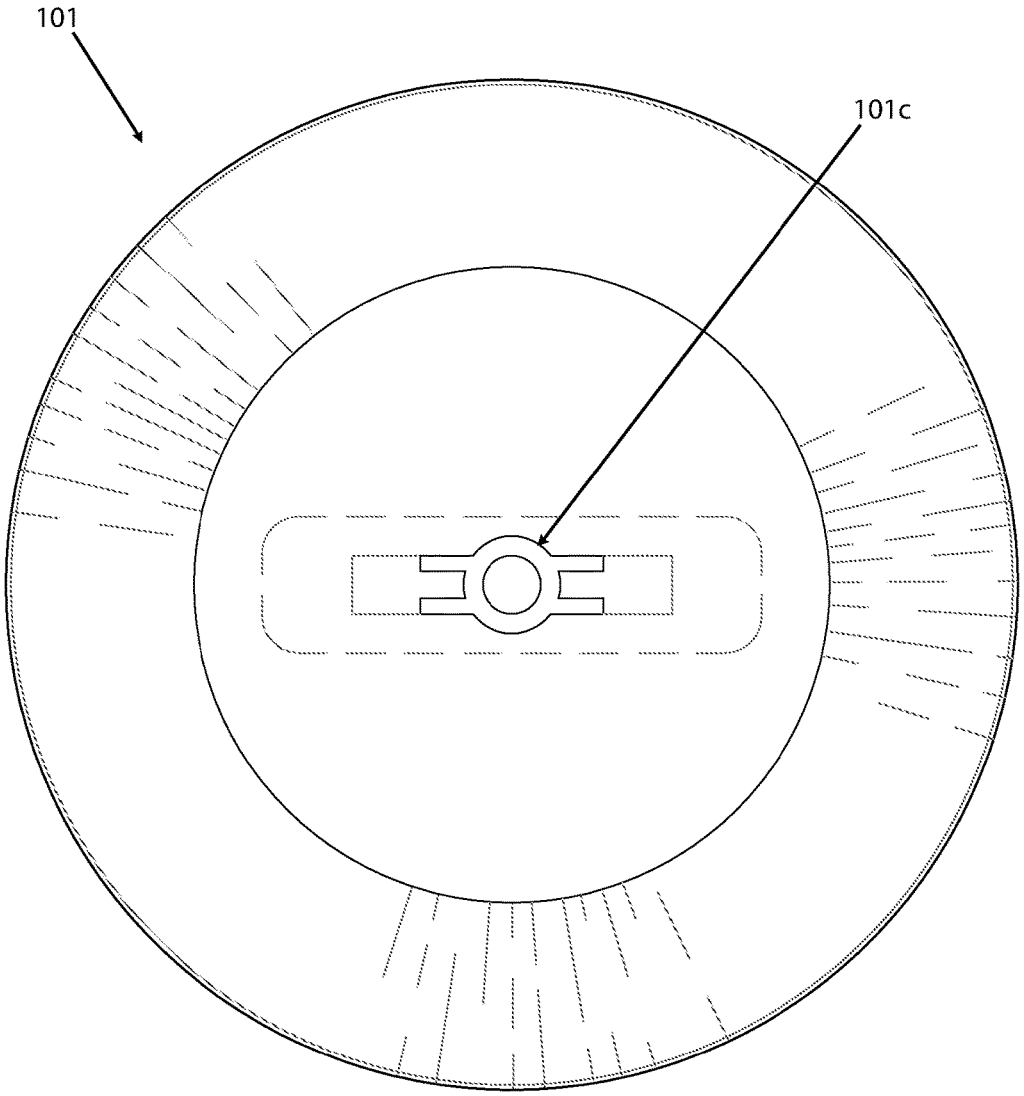
FIG. 17 is bottom plan view of the timer knob portion of the present invention.

FIGS. 13 through 17 show the preferred shape of the timer knob 101 of the present invention in more detail than previously shown. The timer knob 101 includes a handle 101*b* for manual rotation by the user and indicia area 101*a* (shown generically for clarity of illustration) for placement of some suitable visual indicators denoting the passage of time in a known manner when operably coupled with the timer mechanism via coupling 101*c* located on the underside of the timer knob 101 as seen in FIG. 14. As previously described, FIG. 18 exemplifies one alternative indicia arrangement though others may be possible.

FIGS. 19 through 24 show the preferred shape of the timer pedestal 103 of the present invention in more detail than previously shown. The timer pedestal 103 preferably includes a keyed protrusion 103*c* which mates with a central aperture of similar shape in the bowl base. A hole 103*e* within the keyed protrusion 103*c* is provided for passage therethrough of the screw which retains the timer mechanism as previously described. The timer pedestal is prevented from rotating via a key ridge 103*f* provided on the protrusion 103*c*. As well, once the invention is assembled, the timer mechanism is prevented from rotating by raised circular tabs 103*a*, 103*b*, 103*d* located on the side of the timer pedestal 103 which abuts the timer mechanism and which correspond to recesses (not shown) provided within the bottom surface of the timer mechanism. The placement of the key ridge and the raised circular tabs is configured to ensure that the timer mechanism is oriented in order to properly function as a rotary timer having its maximum wind-up point and end point being the location of the timing mark 107.

The foregoing description of certain embodiments of the invention has been presented for the purposes of illustration and description. It is not intended to be exhaustive or to limit the invention to the precise form disclosed. Many modifications and variations are possible in light of the above teachings. Therefore, it is intended that the scope of the invention be limited not by this detailed description, but rather by the claims appended hereto.

What is claimed is:

1. A reusable multi-bowl device for use in mixing hair colorants, said device comprising:

a base having a periphery and a central cavity;

a plurality of lateral tabs arranged around said periphery, said tabs having an erasable surface;

a timer mechanism located within said central cavity;

a marker ring mounted upon said base for rotation around said central cavity; and a plurality of bowls arranged between said central cavity and said periphery.

2. The device as claimed in claim 1 further including a handle located on said base.

3. The device as claimed in claim 2 wherein said handle extends from a top surface of said base to a location coplanar with a bottom surface of said base.

4. The device as claimed in claim 3 further including a timer knob operably connected to said timing mechanism, said timer knob including a face having indicia of time.

5. The device as claimed in claim 4 further including a timing mark located at a fixed point on said top surface of said base, said fixed point being adjacent to said face of said timer knob.

6. The device as claimed in claim 5 further including a timer pedestal fixedly attachable to said base within said central cavity, said timer pedestal including one or more raised tabs abutting said timer mechanism so as to retain said timer mechanism in a stationary position relative to said base.

7. The device as claimed in claim 6 further including a fastener for retaining said timer mechanism within said base.

8. The device as claimed in claim 7 wherein said fastener is a screw configured to adhere said timer mechanism to said timer pedestal.

* * * * *